US005589264A

United States Patent [19]

Yoon et al.

[11] Patent Number: 5,589,264

[45] Date of Patent: Dec. 31, 1996

[54] UNSPUN ACRYLIC STAPLE FIBERS

[75] Inventors: Han S. Yoon; Tae W. Son; Byung C. Kim; Chul J. Lee; Byung G. Min, all of Seoul; Jae W. Cho, Anyang, all of Rep. of Korea

[73] Assignee: Korea Institute of Science and Technology, Seoul, Rep. of Korea

[21] Appl. No.: 446,287

[22] Filed: May 22, 1995

Related U.S. Application Data

[63] Continuation-in-part of Ser. No. 128,657, Sep. 30, 1993, abandoned.

[30] Foreign Application Priority Data

Oct. 1, 1992 [KR] Rep. of Korea ..... 92-18009

[51] Int. Cl.[6] ..... D02G 3/00

[52] U.S. Cl. ..... 428/359; 428/364; 428/357

[58] Field of Search ..... 428/359, 364, 428/357

[56] References Cited

U.S. PATENT DOCUMENTS 2,585,444 2/1952 Coxe .
3,402,231 9/1968 Bynum et al. .
3,774,387 11/1973 Woodell .
3,873,508 2/1975 Turner .
3,896,204 7/1975 Goodman et al. .
3,984,601 10/1976 Blickenstaff .
3,991,153 11/1976 Klausner et al. .
4,163,770 8/1979 Porosoff .
5,219,501 6/1993 Yoon et al. .

FOREIGN PATENT DOCUMENTS 1327140 8/1973 United Kingdom .

*Primary Examiner*—Newton Edwards
*Attorney, Agent, or Firm*—Oblon, Spivak, McClelland, Maier & Neustadt, P.C.

[57] ABSTRACT

A highly-oriented acrylic staple fiber prepared by simple extrusion of a PAN/$H_2O$ melt in a gel crystalline state without spinning is provided. The acrylic fibers according to the present invention are characterized by the following properties: a degree of orientation between 80 and 97% observed by an X-ray diffraction; a length distribution ranging from 5 to 500 mm and a thickness distribution ranging from 5 to 500 μm, a length to thickness ratio ranging from 100 to 100,000 determined by a scanning electromicroscope; a tensile strength of 10 to 70 kg/mm$^2$; an initial tensile modulus of 300 to 1,500 kg/mm$^2$; an elongation of 5 to 20%; and a specific surface area of 1 to 50 m$^2$/g.

3 Claims, 11 Drawing Sheets

UNSPUN ACRYLIC STAPLE FIBERS

This application is a Continuation-in-Part of application Ser. No. 08/128,657, filed on Sep. 30, 1993, now abandoned.

FIELD OF THE INVENTION

The present invention relates to an unspun acrylic staple fiber having a high degree of orientation. More particularly, the present invention relates to a highly-oriented acrylic staple fiber formed by simple extrusion of a polyacrylonitrile(PAN)/$H_2O$ melt in gel crystalline state without requiring spinning procedures.

BACKGROUND OF THE INVENTION

In recent years, acrylic fibers have attracted commercial interest and attention as industrial materials, such as an asbestos-substitutive fiber, a heat insulating fiber, a heat resistant fiber, a cement reinforcing fiber, and a fiber for specialty paper, in addition to their usual use as clothing materials. The acrylic fibers for industrial use should be in the form of short fibers.

In the prior art techniques, polyacrylonitrile (PAN) is first dissolved in an appropriate solvent to form a spinning solution (dope) which is then subject to wet- or dry-spinning and subsequent drawing to produce a filament. In particular, PAN has similar properties to stiff chains, since the molecular chains of PAN are twisted to form an irregular helix due to the strong polarity of the nitrile groups in the side chains thereof. See, W. R. Krigbaum et al., Journal of Polymer Science, Vol. XLIII, pp. 467–488, 1960. When adding a strong polar solvent, such as dimethylformamide, dimethylacetamide, dimethylsulfoxide, an aqueous NaSCN solution, an aqueous $ZnCl_2$ solution, and an aqueous $HNO_3$ solution, the nitrile groups of PAN attract the molecular chains of the solution to couple therewith even at ambient temperature, and thereby the molecular chains are broken to form a fluidizable solution. Upon spinning the resulting solution through a small opening of a spinneret and subsequent removal of the solvent, PAN is solidified to form a filament. The filament thus obtained must be cut into a desired length to produce a staple fiber.

However, the solvents used are now recognized as a causative substance which may contribute to environmental pollution. Moreover, the complicated steps of extracting, recovering and purifying the solvents, as well as the maintenance of anti-pollution facilities, increase the production cost. Further, the filament thus formed appears to be a fiber, but it still remain substantially unoriented. Accordingly, the filaments thus obtained must be subject to drawing in a high stretch ratio of 5 to 30 in order to afford a complete fibrous structure in which the molecular chains are arranged in parallel with the axis of the fiber. This may also increase production costs.

In the case of an acrylic fiber having large surface areas, the process for manufacturing the same involves the more complicated steps of providing a spinning solution, spinning the solution, solidifying the spun filament, removing and recovering the solvent used, drawing and cutting the filament, fibrillizing the resulting fiber, and so forth.

In general, the acrylic fibers prepared by the prior art techniques are inadequate as spun yarns due to their poor elasticity and slippery surface. Further, they are not satisfactory in terms of their reinforcing, heat insulating, and binding properties which are required of an industrial material.

As an attempt to solve the problems encountered in the prior art techniques mentioned above, it has been suggested to use water in place of the hazardous solvents. Most such processes involve heating a hydrate of PAN to form a PAN/$H_2O$ melt, and spinning the melt followed by drawing to give a PAN fiber. For example, U.S. Pat. No. 2,585,444 discloses that a PAN fiber can be produced by heating a PAN hydrate containing 30 to 85% water (by weight) above the melting point of the PAN hydrate to give a melted fluid and then melt-spinning the resulting fluid. U.S. Pat. Nos. 3,896,204 and 3,984,601 disclose a process in which a PAN hydrate containing about 20 to 30% water (by weight) is heated at a temperature ranging from 170° to 205° C. and the resulting amorphous melt is then subject to spinning and drawing in a stretch ratio of above 5 to give a fiber. U.S. Pat. Nos. 3,991,153 and 4,163,770 disclose a process in which a PAN hydrate containing 10 to 40% water (by weight) is heated and spun at a temperature above the melting point of the hydrate, that is, a temperature above which the melt forms an amorphous single phase, and the spun filament is then subject to drawing in a stretch ratio of 25 to 150 within a pressure vessel.

As explained above, the prior art processes involve a step of spinning a PAN/$H_2O$ melt. However, since the spinning is carried out within the temperature range at which the melt exists in a random amorphous state, fibers in which the molecular chains of PAN are highly oriented cannot be obtained without a subsequent step of drawing in a high stretch ratio.

U.S. Pat. Nos. 3,402,231, 3,774,387 and 3,873,508 disclose a process in which a PAN melt containing at least 50% water (by weight) is first prepared at about 200° C., and the resulting melt is then spun to form fibers. However, such large amounts of water contained therein and such high temperatures provide a PAN/$H_2O$ melt in a random, amorphous form. The filaments obtained from the melt have a profile of fibers, but are, in reality, no more than a continuous foam which does not possess any oriented molecular chains nor fibrous structures.

British Patent No. 1,327,140 discloses that fibrils can be prepared by premolding PAN at an elevated temperature under high pressure followed by solid extrusion. However, it is hard to obtain a fibril of greater than several tens of millimeters in length by this prior art process. Furthermore, the fibril obtained by the process is discolored dark brown, being valueless for use in clothing.

We, the present inventors, in the course of undergoing an extensive study of a two-component system comprising PAN and water, have unexpectedly found that a PAN/$H_2O$ mixture forms an amorphous melt at a temperature range above the melting point of the mixture. The melt, even if cooled to temperatures below the above melting temperature, is not solidified and still maintains its supercooled, melted state until the cooling temperature arrives at a selected temperature range. When further cooled to the temperature below the solidifying temperature ($T_c$), the melt is crystallized and is returned to its original state. However, when the PAN/$H_2O$ melt is cooled to form the supercooled state at a temperature below the melting point, the melt forms a gel crystal having a molecular order unlike the amorphous melt formed above the melting temperature. The gel crystal allows PAN to easily obtain a molecular orientation upon extrusion. The phenomenon that PAN, together with water, forms a gel crystal has first been found by the present inventors. It appears that in the gel crystal, the PAN molecular chains, together with water molecules, form innumerable, fine units having a certain order, and the units are arranged in three dimension so as to form a regular phase of super lattice structures which allow the molecules to be easily arranged.

The molecular chains of PAN in the gel crystalline state have a self-orientating property. Thus, if some weak directional shear forces are applied to the PAN/$H_2O$ melt, the PAN molecules easily form a highly-oriented fibrous structure. In other words, if the gel crystal is extruded, the PAN molecular chains are aligned, while water contained in the melt is spontaneously expelled out of the system. As water is expelled, the PAN molecules are extended and gathered in parallel with each other so that a fiber structure is formed, thereby producing highly-oriented fibers even without a separate drawing process.

U.S. patent application Ser. No. 07/709,872 which was filed oil Jun. 4, 1991 in the name of the present inventors and is still pending, discloses pulp-like acrylic short fibers, prepared by simple extrusion of a PAN/$H_2O$ melt in gel crystalline state and mechanically beating the resulting extrudate. The fibers are featured by having a highly-oriented fibril structure, a thickness distribution of 0.1 to 10 μm, and a length distribution of 0.1 to 100 mm.

U.S. patent application Ser. No. 08/064,345 filed on May 20, 1993, which is a file wrapper application of U.S. Ser. No. 07/804,457 filed on Dec. 10, 1991, by the present inventors, shows a heat- and chemical-resistant, pulp-like, acrylic short fiber featuring a thickness distribution of 0.1 to 50 μm, a length distribution of 1 to 20 mm, a thermal transitional temperature of above 200° C., and a solubility of less than 5% in dimethyl formamide at room temperature. According to the invention disclosed in the above pending application, the extrudate is formed from gel-crystalline PAN/water without spinning, and the extrudate is then subject to heat stabilization.

SUMMARY OF THE INVENTION

It is therefore an object of the invention to provide an unspun acrylic staple fiber having highly-oriented molecular chains which is useful for spinning.

It is another object of the invention to provide unspun, highly-oriented acrylic staple fibers which are prepared by simple extrusion, thereby eliminating the spinning and the subsequent drawing processes, both of which are necessarily conducted in the prior art techniques.

Other objects of the invention will become apparent through reading the remainder of the specification.

These and other objects can be achieved by providing a white acrylic staple fiber which is prepared by a simple extrusion of a gel crystal formed from a PAN/$H_2O$ mixture without spinning, consisting of fibrils which are extended and uniformly gathered in parallel with each other, and said fiber having the following properties: a degree of orientation observed by X-ray diffraction of 80–97%; a length of 5–500 mm; a thickness of 5–500 μm; a length to thickness ratio of 100–100,000 determined by a scanning electromicroscope; a tensile strength of 10–70 kg/mm$^2$; an initial tensile modulus of 300–1,500 kg/mm$^2$; an elongation of 5–20% and a specific surface area of 1–50 m$^2$/g.

BRIEF DESCRIPTION OF THE DRAWINGS

The present invention is described in detail with reference to the accompanying drawings.

DETAILED DESCRIPTION OF THE INVENTION

Figure 1A:
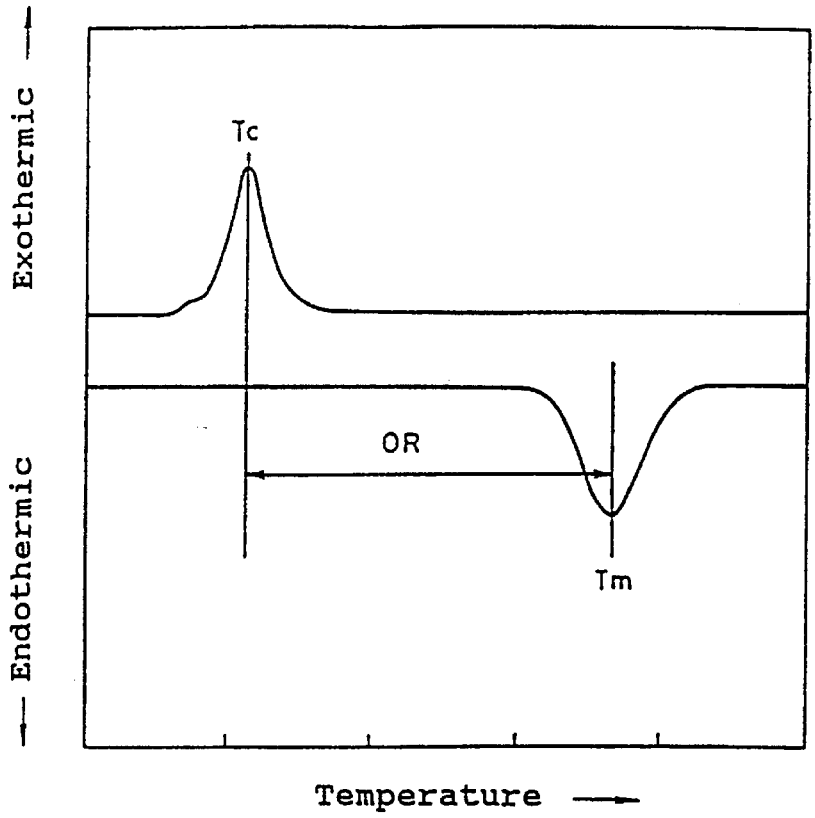
FIG. 1A illustrates typical melting endothermic and solidifying exothermic peaks, observed by a differential scanning calorimeter (DSC), of a PAN/$H_2O$ mixture. The temperature range (OR) in which a gel crystal having a molecular order can be formed resides between the melting temperature ($T_m$) of the mixture and the solidifying temperature ($T_c$) of the melt.

The acrylic staple fibers of the invention can be prepared by simple extrusion of a PAN/$H_2O$ melt in gel crystalline state without separate spinning. The process for preparing the acrylic fibers according to the invention is described in detail below.

An acrylonitrile homopolymer or a copolymer consisting of at least 80% acrylonitrile (by weight) and at most 20% one or more copolymerizable monomers (by weight) and having a viscosity average molecular weight of 10,000 to 1,000,000 is mixed with 10 to 100% water (by weight) to form a PAN/$H_2O$ mixture. The PAN/$H_2O$ mixture is heated in a hermetically sealed container above the melting temperature ($T_m$) to form an amorphous PAN/$H_2O$ melt. The amorphous melt is then cooled to a temperature between the melting temperature of the PAN/$H_2O$ mixture and the solidifying temperature of the melt to form a gel crystal. The resulting gel crystal is extruded through a desired extrusion die to give a highly-oriented extrudate having a fiber structure which is laminated by spontaneous discharge of water and solidification of the extrudate. The resultant is a highly-oriented extrudate having a fiber structure wherein fibrils are arranged and uniformly laminated in the direction of extrusion. The extrudate thus obtained can be easily divided in a longitudinal direction to form filaments, like natural fibers such as hemp, flax, ramie, etc. The individual filaments are similar to natural fibers in its appearance. The highly-oriented extrudate is cut into a desired length, and subject to opening to form a white staple fiber. The orientation and mechanical properties of the fibers can further be enhanced if the extrudate is subject to heat-elongation at an elongation ratio of 5 to 100% under air or steam at 90° to 200° C.

According to the present invention, an acrylic staple fiber can be prepared directly from the raw material, PAN, without the conventional step of forming a filament. The fibers thus prepared can be said to be a new concept third generation synthetic fiber which follows the principles and mechanisms of forming natural fibers such as cotton, flax, etc. The third generation synthetic fibers are featuring the polymer chains consisting of the fiber-types of microfibrils which are arranged and gathered to form a fiber.

The term "PAN" as used herein, is meant to refer to both a homopolymer of acrylonitrile and a copolymer of acrylonitrile with one or more monomers copolymerizable with the acrylonitrile. The term "copolymer" refers to those comprising at least 80%, and preferably at least 85% acrylonitrile (by weight) and at most 20%, but preferably 15% copolymerizable monomer (by weight).

The representative copolymerizable monomers include addition polymerizable monomers containing an ethylenically unsaturated bond, such as methacrylate, methyl methacrylate, ethyl acrylate, chloroacrylic acid, ethyl methacrylate, acrylic acid, methacrylic acid, acrylamide, methacrylamide, butyl acrylate, methacrylonitrile, butylmethacrylate, vinyl acetate, vinyl chloride, vinyl bromide, vinyl fluoride, vinylidene chloride, vinylidene bromide, allyl chloride, methyl vinyl ketone, vinyl formate, vinyl chloroacetate, vinyl propionate, styrene, vinyl stearate, vinyl benzoate, vinylpyrrolidone, vinylpiperidine, 4-vinylpyridine, 2-vinylpyridine, N-vinylphthalimide, N-vinylsuccinamide, methyl malonate, N-vinylcarbazol, methyl vinyl ether, itaconic acid, vinylsulfonic acid, styrenesulfonic acid, allylsulfonic acid, methallylsulfonic acid, vinylfuran, 2-methyl-5-vinylpyridine, vinyl naphthalene, itaconic ester, chlorostyrene, vinyl sulfonate, styren sulfonate, allylsulfonate, methallylsulfonate, vinylidene fluoride, 1-chloro-2-bromoethylene, α-methylstyrene, ethylene, propylene, and the like.

The molecular weight of PAN is given as a viscosity average molecular weight (Mv) and calculated from the intrinsic viscosity [η] determined by using N,N-dimethylformamide as a solvent according to the following equation:

$$[\eta]=3.35\times10^{-4}Mv^{0.72}$$

wherein the intrinsic viscosity [η] is determined at 30° C. in a solution of PAN in N,N-dimethyformamide. See, T. Shibukawa et al., Journal of Polymer Science, Part A-1, Vol. 6, pp.147–159, 1968.

The molecular weight of PAN used in the invention is between 10,000 and 1,000,000, preferably from 100,000 to 500,000.

The mixture of PAN and water may contain 0.1 to 10% an additive (by weight) to facilitate the extrusion operation and the formation of fibrils. Suitable such additives include a water soluble polymer, a water swelling polymer, a hydrocarbon having a lower melting point, or the mixture thereof. As the water soluble or water swelling polymer, polyvinylalcohol, polyacrylic acid or its water soluble salt, polyethylene oxide, polyacrylamide, starch, or carboxymethylcellulose or its water soluble salt or fatty acid salt may be mentioned. As the hydrocarbonate having a low melting point, paraffin oil, paraffin, polyethylene, polypropylene and fatty acid may be mentioned. These additives suppress instantaneous evaporation of steam when extruding the mixture and improve the extrudability, thereby preventing any possible destruction of the fibrils by blowing and also improves the orientation of the extrudate.

According to the invention, PAN is mixed with a predetermined amount of water to give a PAN/$H_2O$ mixture or a PAN hydrate. The hydrate is placed in a pressure vessel and heated above its melting point ($T_m$) as illustrated in FIG. 1A. During heating, steam pressure is generated, and PAN is associated with water to form a PAN/$H_2O$ melt. The heating may be carded out under pressurized condition by introducing an inert gas, such as nitrogen or argon, into the vessel.

Figure 2A:
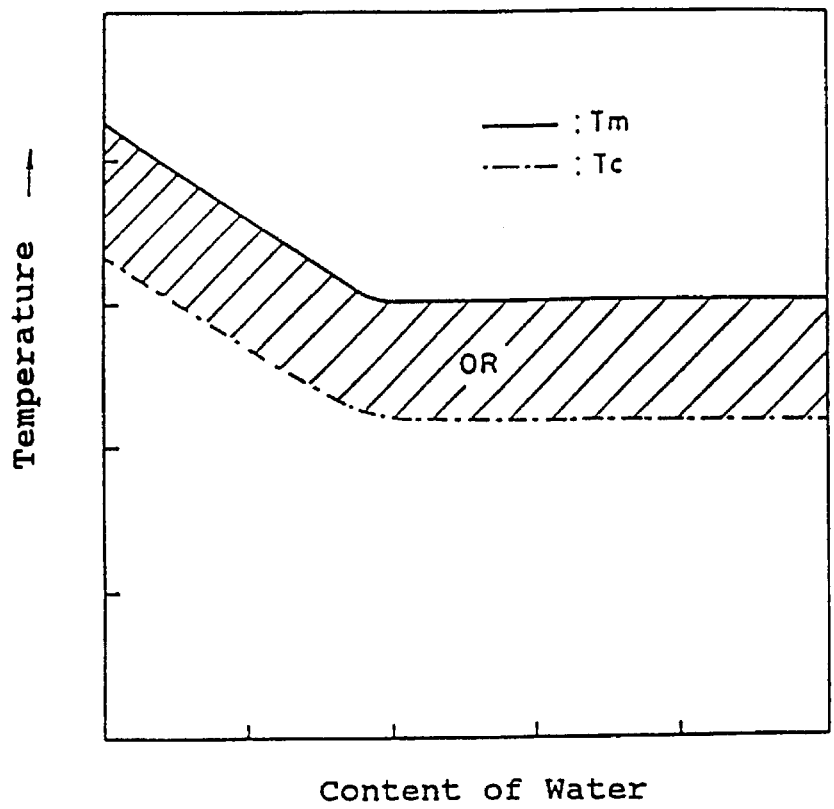
FIG. 2A is a graph illustrating typical changes in the melting and the solidifying temperatures of PAN/$H_2O$ mixtures as a function of the water content. The shaden portion indicates the temperature region wherein the gel crystal having a molecular order is formed.

The resulting melt is a random, amorphous fluid. If the amorphous melt is cooled to and maintained at a temperature between the melting temperature and the solidifying temperature as indicated in FIG. 2A, particles are formed in gel crystal form. The particles exist in fluid form even below the melting point, and have an internal molecular order. The crystal is easily oriented even under a weak directional shear force, aligning the molecular chains of PAN. It is believed that in the gel crystal state, the molecular chains of PAN are extended and arranged in parallel with each other by the interaction between the molecular chain and water. The gel crystal has self-orientation property like liquid crystals.

Figure 3:
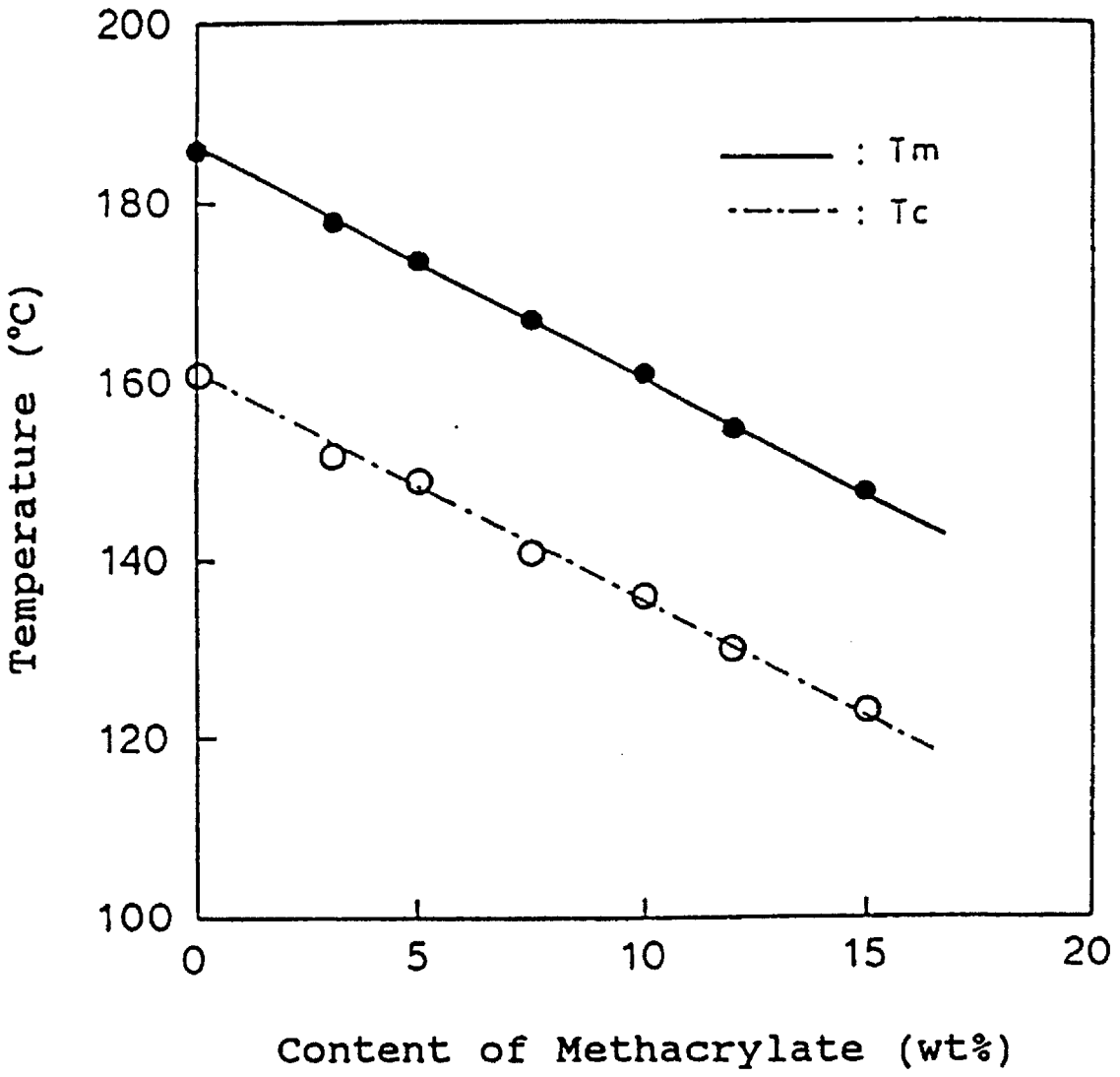
FIG. 3 is a graph illustrating changes in the melting and the solidifying temperatures of a PAN/$H_2O$ mixture as a function of the content of methacrylate as a comonomer, indicating that as the methacrylate content in the PAN increases, both the melting temperatures and the solidifying temperatures as defined above are lowered.
Figure 4:
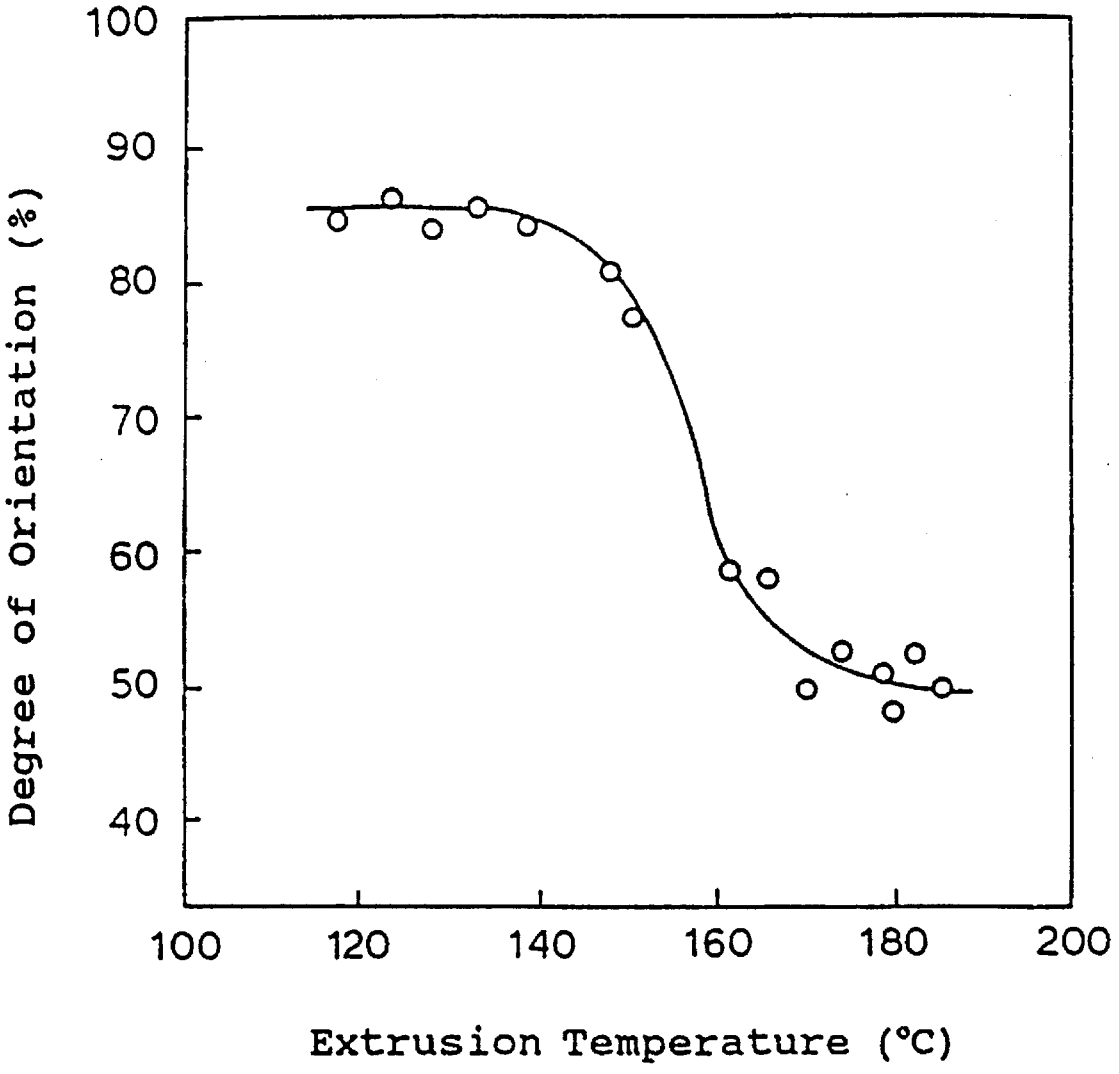
FIG. 4 is a graph illustrating the degree of orientation of an extrudate produced by extruding a melt of a PAN/$H_2O$ mixture as a function of the extrusion temperature. It can be seen that in the temperature range wherein an amorphous melt is formed, a substantially unoriented melt is obtained, i.e., the degree of orientation is below about 50%, while in the temperature range wherein a gel crystal is formed, an extrudate having a high molecular orientation is obtained, i.e., the degree of orientation is above 80%.

The temperature within which the gel crystal having a molecular order is formed ranges from $T_m$ to $T_c$ as indicated in FIG. 1A. The temperature range depends on the amount of acrylonitrile contained in PAN (See FIG. 3), and/or the amount of water contained in the hydrate (See FIG. 2A). FIG. 4 reveals that the extrudates produced at an elevated temperature at which the amorphous melt is formed, show a low degree of orientation (below 50%), while the extrudates produced from the gel crystalline melt show a high degree of orientation (above 80%). Preferably, the water content contained in the melt ranges from 10 to 100 parts by weight, more preferably, 20 to 60 parts by weight, with respect to the total weight of PAN.

In another embodiment, the PAN/$H_2O$ melt can be prepared from an acrylonitrile copolymer comprising acrylonitrile monomer and one or more copolymerizable monomers. The acrylonitrile monomer and the copolymerizable monomers are mixed with an appropriate amount of water. After adding a polymerization initiating agent such as peroxides, the resulting mixture is fed by a gear pump into a twin screw extruder, where the mixture is heated thus causing polymerization to produce a PAN/$H_2O$ slurry. After any unreacted monomers are vented out, and the slurry is further heated and subject to polymerization to give a PAN/$H_2O$ melt.

Figure 5B:
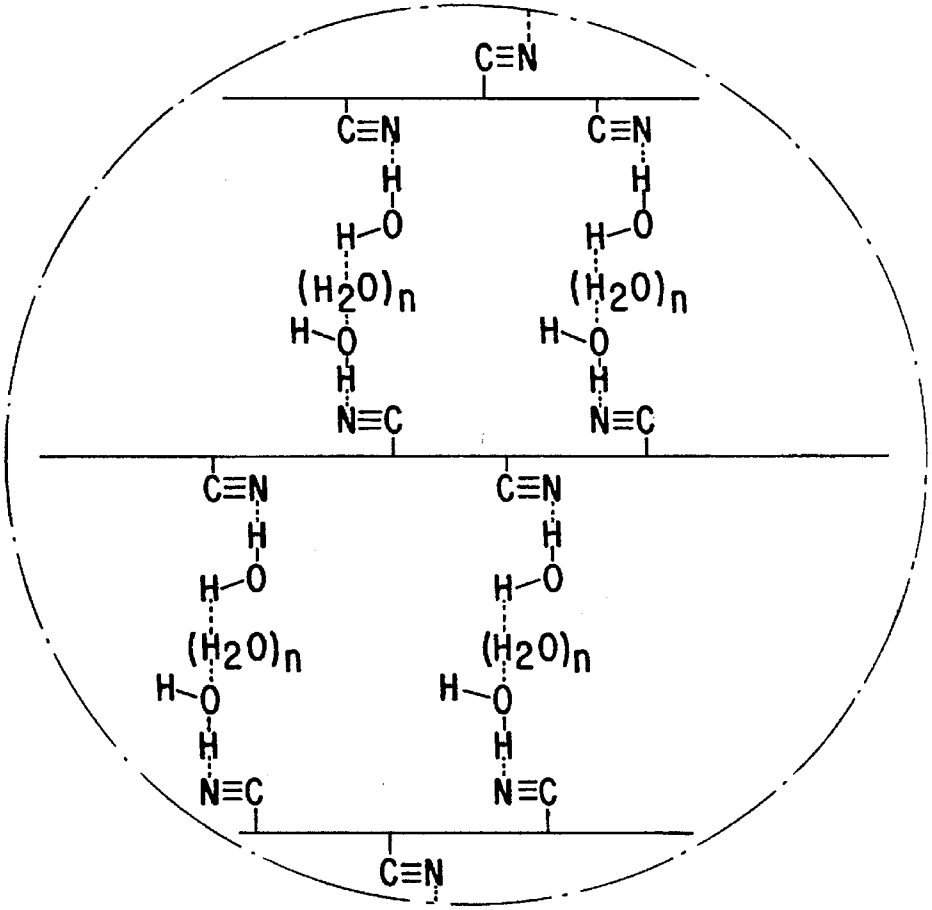
FIG. 5(B) and FIG. 5(D) illustrate the structural model of polyacrylonitrile chains in which when fibers are formed by extrusion and solidification, the polyacrylonitrile chains form fibrils in the extended chain configuration. Polymer chains are extended in the arrow "C" direction and a Van der Waals force acts in the arrow "V" direction. After water is drained away from the melted gel crystal, the crystal shrinks to form fibers with a space, and a dipole-dipole attraction between nitrile groups acts in the arrow "D" direction in lieu of the hydrogen bonding force that acts in the arrow "H" direction in the melted gel crystal.
Figure 5A:
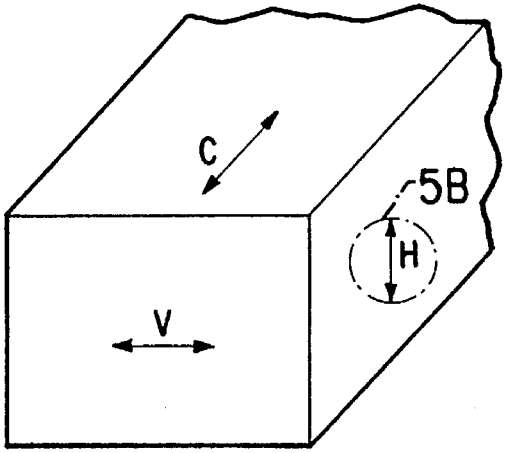
FIG. 5A and FIG. 5(C) illustrate a structural model of a three-dimensional molecular order of polyacrylonitrile chains formed by the interaction of polyacrylonitrile chains with water molecules when the gel crystal of PAN/$H_2O$ mixture is extruded.
Figure 5D:
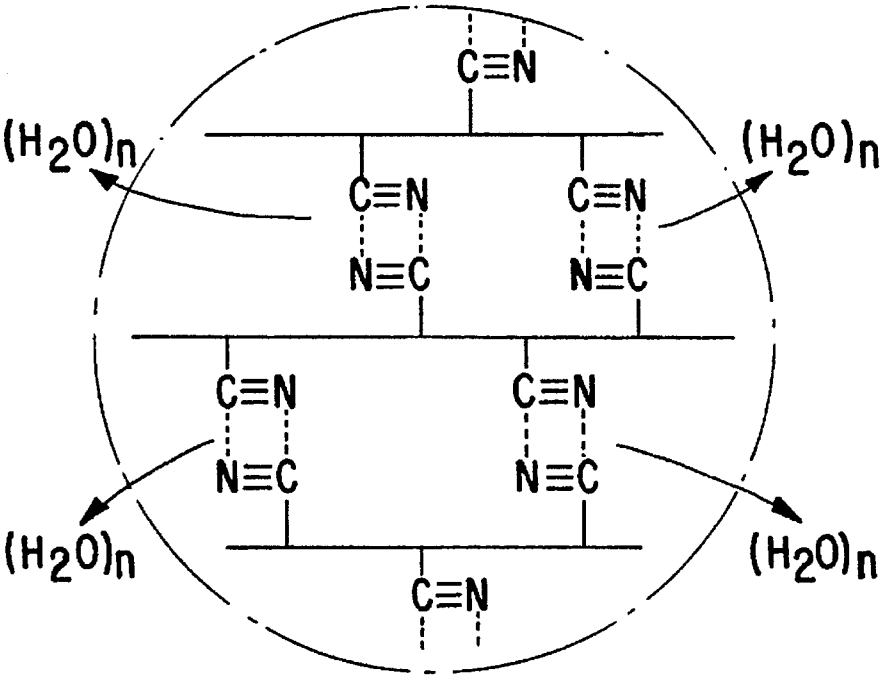
Figure 5C:
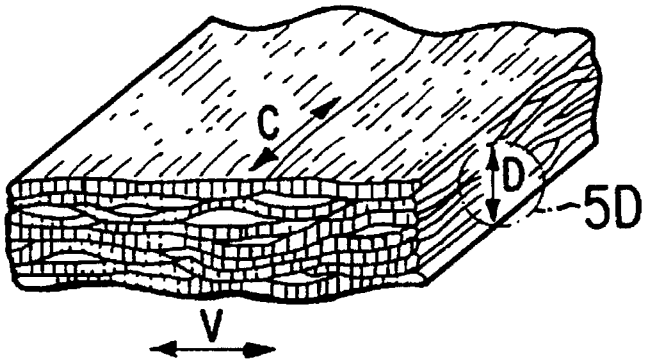

The molecular chains of PAN contained in the random, amorphous PAN/$H_2O$ melt can move freely. As such, the molecular chains are irregularly conglomerated and thus do not have any molecular order. If the amorphous melt is cooled to and maintain within a temperature range, the individual molecular chains of PAN are restricted in their movement and are bound by the intermolecular attraction which exists between the molecular chain of PAN and the molecules of water. As a result, a gel crystal is formed in which the molecular chains have an extended-chain conformation and are arranged in order and in parallel with the adjacent molecular chains at a distance. Since in the gel crystal thus formed, the molecular chains of PAN maintain their molecular order, it is difficult for the molecular chains to move independently. But, when the whole molecular chains constituting the gel crystal are moved in a single direction, the molecular chains are easily transformed into a three-dimensional orientation structure as depicted in FIG. 5(A). Upon solidification, the molecular chains of three-dimensional structure are easily arranged in a single direction to have an extended chain conformation, resulting in a highly-oriented fiber. On the other hand, in the case of an amorphous melt, the individual PAN molecular chains move freely and do not have any molecular order. Thus, it is practically impossible to have the molecular chains of PAN contained in the amorphous melt arranged in a single direction by a weak shear force.

Since the gel crystal according to the invention has a spontaneous molecular orientation property, the molecular chains of PAN can be processed by simple extrusion into an extrudate in which the molecular chains of PAN are highly oriented in a single direction, and the fibers consisting of microfibrils are uniformly laminated.

Any known extruders can be used in the present invention. However, the preferred examples include a screw extruder or a piston extruder. Any known extrusion dies can also be used, which include a slit die, a circle die, a tube die, an arc-shaped die and the like. It is preferable to use an extrusion die with a width larger than its length. The extrusion is effected within a temperature range which can form a PAN/$H_2O$ melt in gel crystal form. The extrusion conditions are controlled so that the internal pressure of the extruder is maintained at self-generated steam pressure or higher in order to eject the melt from the die to the atmosphere at ambient temperature and pressure. To increase the production rate, it is preferred to apply a higher pressure to the inside of the extruder to increase the exit rate. In addition, the extrudate can be drawn at a line rate higher than the extrusion rate in order to increase the degree of orientation.

Figure 6:
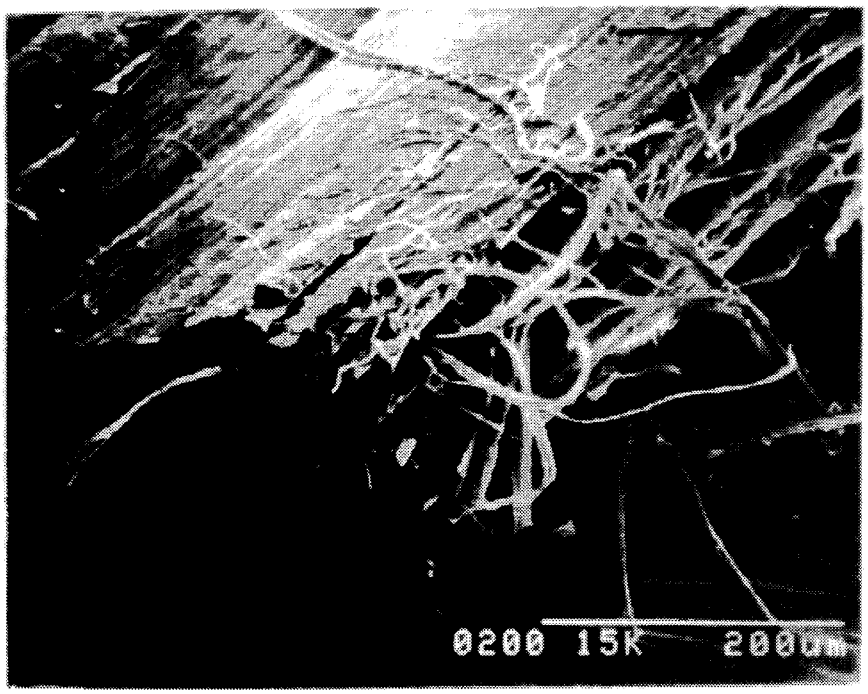
FIG. 6 is a photograph from a scanning electron microscope, of the cross-section and the longitudinal section of the highly-oriented extrudate that is formed by extruding the gel crystal. The extrudate has a cross-section of fibrils laminated such that space forms from areas where water has been drained away and also shows that the individual fibrils consists of microfibrils.
Figure 7:
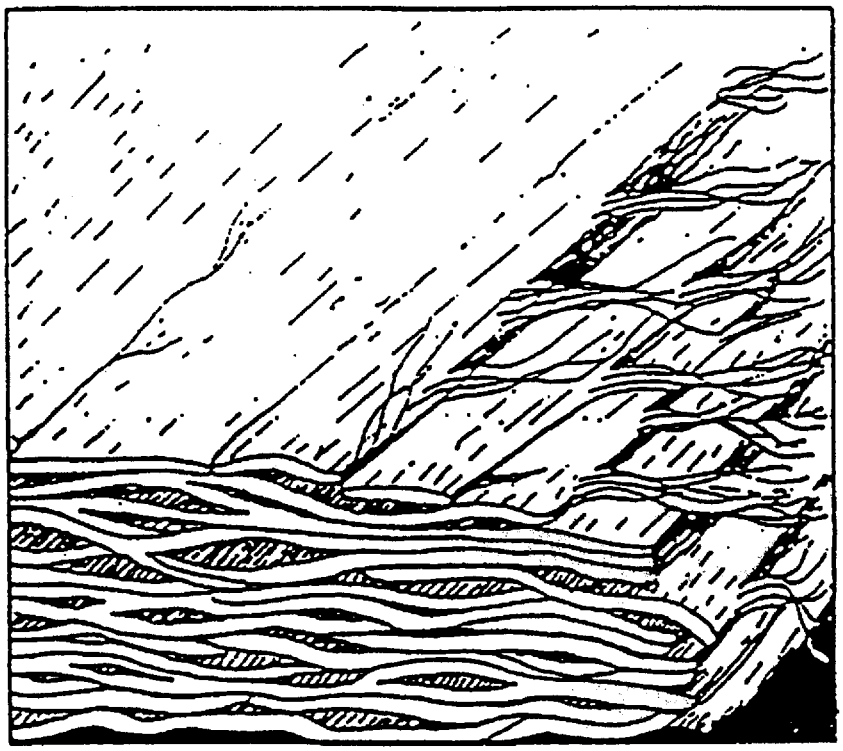
FIG. 7 is a drawing of the highly-oriented extrudate of FIG. 6, showing that the extrudate has a cross-section where fibrils are laminated at proper intervals such that the dehydration space is retained between the fibrils. The individual fibrils consist of numerous microfibrils and that these fibrils and microfibrils are easily divided to form a separate fiber.

Upon extrusion and solidification of the gel crystal, an extrudate consisting of fibers is formed wherein the fibrils arranged in the direction of extrusion are laminated uniformly in such a manner that the space from which water is removed is retained between the fibrils (FIG. 6).

Figure 9:
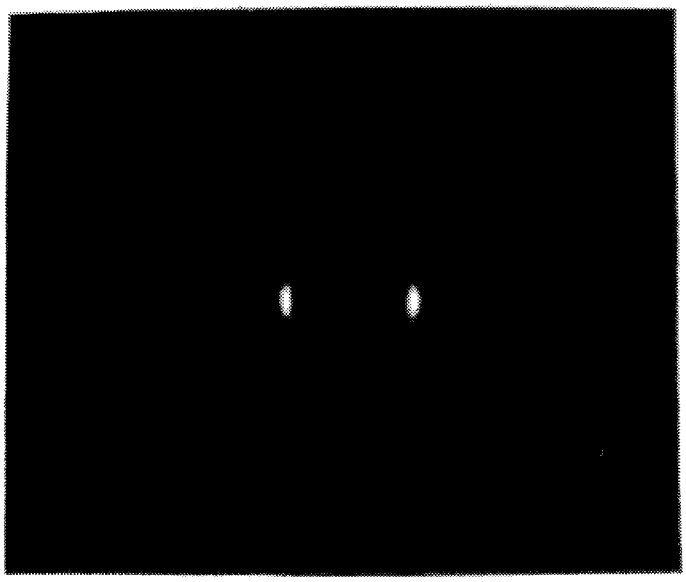
FIG. 9 is an X-ray diffraction pattern of the staple fiber of FIG. 8, showing that a staple fiber having fibrous crystals and highly-oriented structures is formed.
Figure 10:
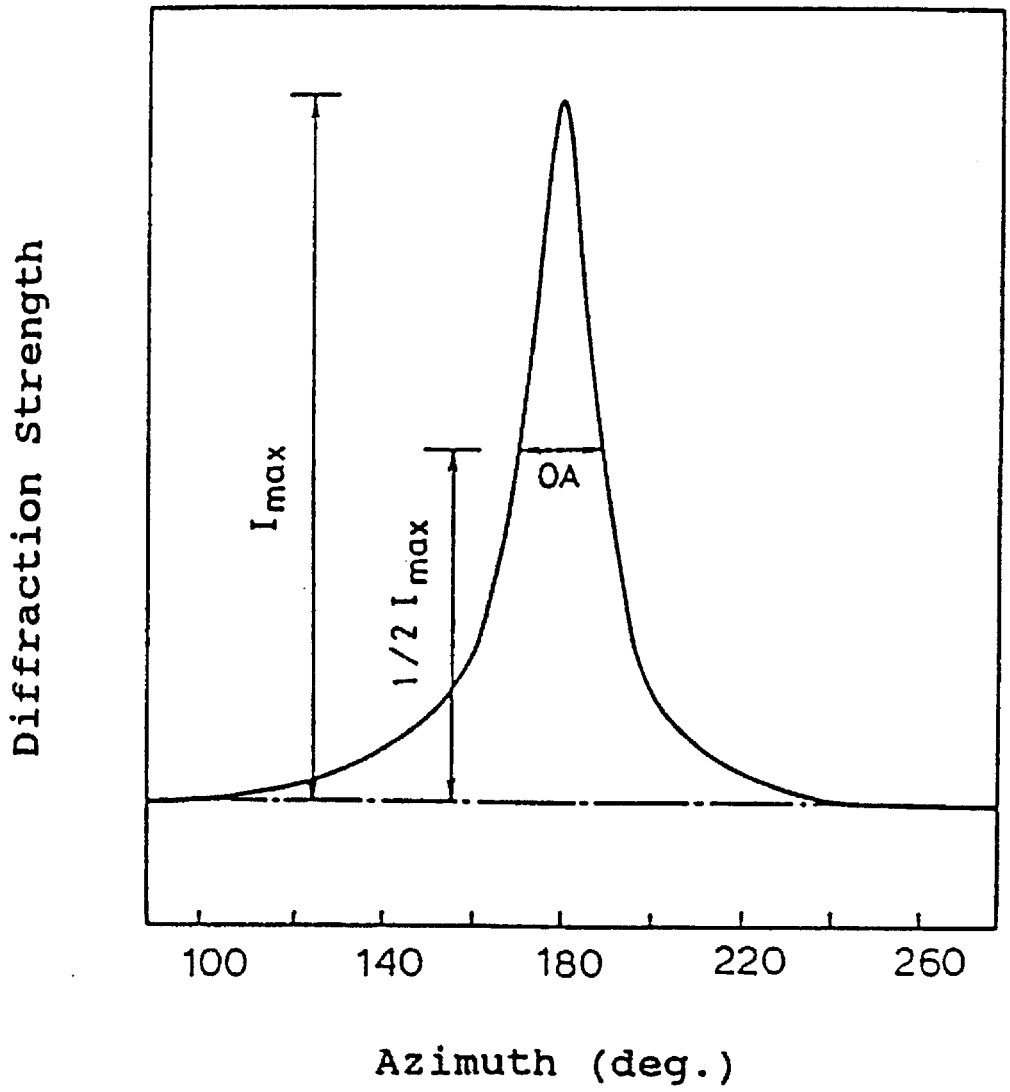
FIG. 10 illustrates a diffraction strength curve observed by an azimuthal scanning at the main diffraction peak ($2\theta$= 16.8°) on the X-ray diffraction pattern as illustrated in FIG. 9, showing that the staple fiber possesses a highly-oriented structure.

The fibrils are 0.1 to 5 μm in thickness. The fiber prepared from the fibrils has a fibrous structure identified by the X-ray diffraction pattern as shown in FIG. 9 and shows a high degree of orientation ranging from 80 to 95%.

The degree of orientation is calculated from the half-maximum width (OA) according to the following equation:

$$\text{Degree of orientation (\%)} = \frac{180 - OA}{180} \times 100$$

wherein OA is the width at the one half value of the peak diffraction strength of the main diffraction as scanned in an azimuthal direction at the peak position ($2\theta$=16.8°).

The degree of orientation of the highly-oriented extrudate can be further increased by elongating the extrudate under heat. For example, elongation at 90° to 200° C. provides an extrudate having a degree of orientation of 90 to 97%. The thickness of the fiber can vary within a wide range, for example, from 0.1 μm corresponding to the thickness of a fibril, to several millimeters.

Figure 8:
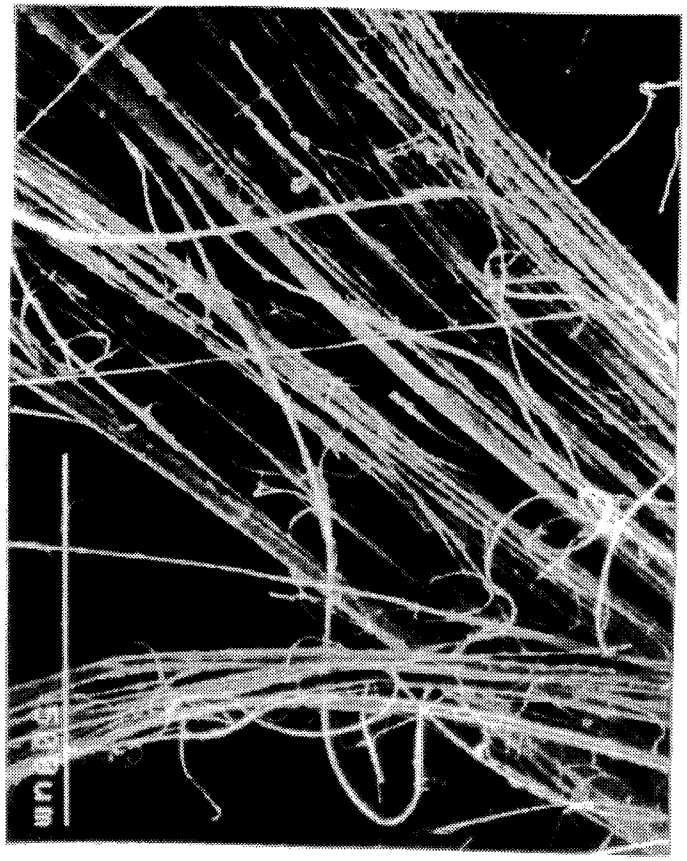
FIG. 8 is a photograph from an electron microscope of the staple fiber obtained from the highly-oriented extrudate of FIG. 6 by using an opener, showing that each fiber consists of fibrils and has an irregular cross-sectional configuration and numerous microcrevices and branched fibrils formed on the side portion of the fiber.

The fibrous extrudate consisting of the fibrils thus obtained can be easily opened. The resulting fiber is opened and cut into a desired length to obtain a staple fiber, as shown in FIG. 8. The size of the fiber can be adjusted by varying the cutting length and the opening conditions. The resulting fiber consists of a plurality of fibrils and has an irregular cross-sectional configuration and a large number of micro-crevices and branched fibrils formed on the side area, which is distinguishable from conventional filament fibers formed through spinnerets.

The fibers of the invention have a thickness distribution between 5 to 500 μm, with a length to thickness ratio of 100 to 10,000. The length of the fiber can be adjusted from several millimeters to several hundreds millimeters and if necessary, to several hundreds centimeters. The individual fibers consist of a large number of fibrils having a thickness of 0.1 to 5 μm, and the fibrils, in turn, consist of microfibrils having a thickness of 1 μm or less. The crystal structure and the degree of orientation of the fiber were identified by the X-ray diffraction pattern above mentioned. The X-ray diffraction patterns shows that the fiber consists of a fibril and has a highly-oriented structure. The specific surface area of the fiber has a value ranging from 1 to 50 $m^2/g$, as measured by the nitrogen adsorbing method.

The fibers according to the invention having a length of 20 mm or more, show a strength of 10 to 70 $kg/mm^2$, an initial tensile modulus of 300 to 1,500 $kg/mm^2$, and an elongation of 5 to 20%.

Meanwhile, the extrudate can also be fabricated into pulp-like fibers by cutting it into the desired length, followed by beating in place of opening. Pulp-like fibers of various sizes can be obtained, depending on the length and beating conditions. The pulp-like fibers have a thickness distribution ranging from 1 to 50 μm and a length distribution ranging from 1 to 20 mm. The pulp-like fibers can be successfully used in the conventional paper-making processes using woody pulp. The pulp-like fibers of the invention can be admixed with the woody pulp in a desired ratio.

Determination by a differential scanning calorimeter, depending on the water content in the hydrate, temperature and PAN composition, can provide information on the existence of the temperature region in which a gel crystal is formed, as illustrated in FIGS. 1A and 2A. The two-component system consisting of PAN and water begins to change its phase at temperatures greater than a boiling point of water under ambient pressure. It is therefore possible to obtain the melting endothermic and solidification exothermic peaks when heating and cooling by using a pressure-resistant capsule with a large volume, which can endure the high pressure to be applied (Perkin-Elmer port 319-0128).

As indicated in FIG. 1A, the apex of the endothermic peak indicates the melting temperature ($T_m$), and the apex of the exothermic peak indicates the solidification temperature ($T_c$). The temperature range between the melting temperature and the solidification temperature corresponds to the temperature region wherein the gel crystal is formed. Generally, the temperature range is between 130° and 180° C.

FIG. 2A shows the temperature region in which the gel crystal is formed versus the change in the water content. FIG. 3 shows the change in the temperature region with a change in the composition of PAN.

Figure 1B:
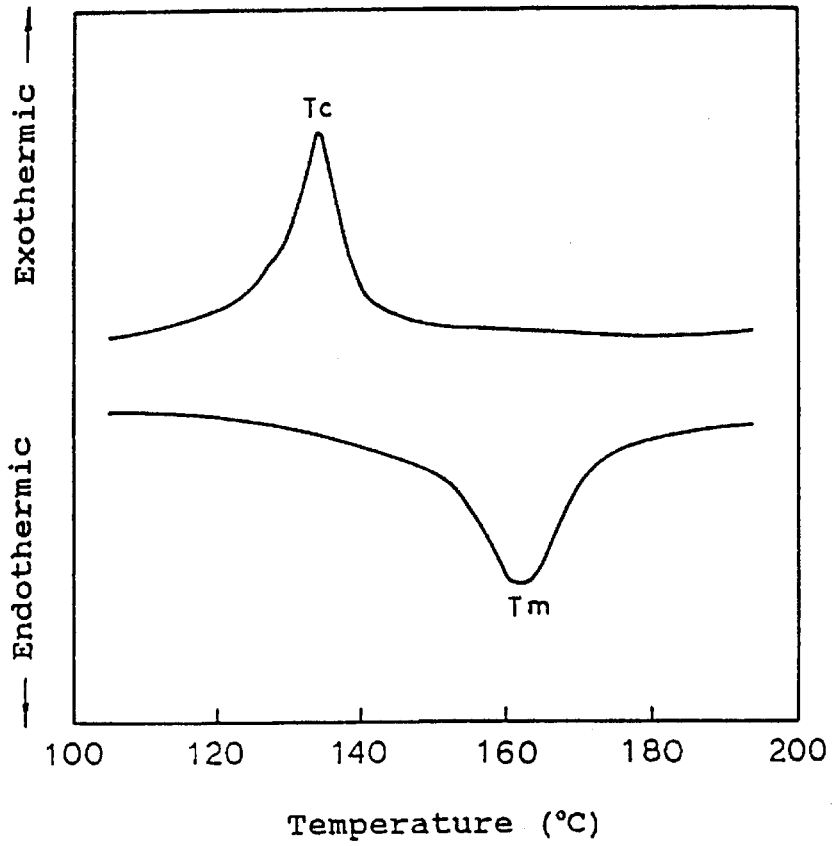
FIG. 1B is a graph which shows the melting endothermic peak and the solidifying exothermic peak of a PAN/$H_2O$ mixture that contains PAN consisting of 92.8% acrylonitrile (by weight) and 7.2% methylacrylate (by weight), in admixture with 30 parts water (by weight) with respect to the total weight of PAN.
Figure 2B:
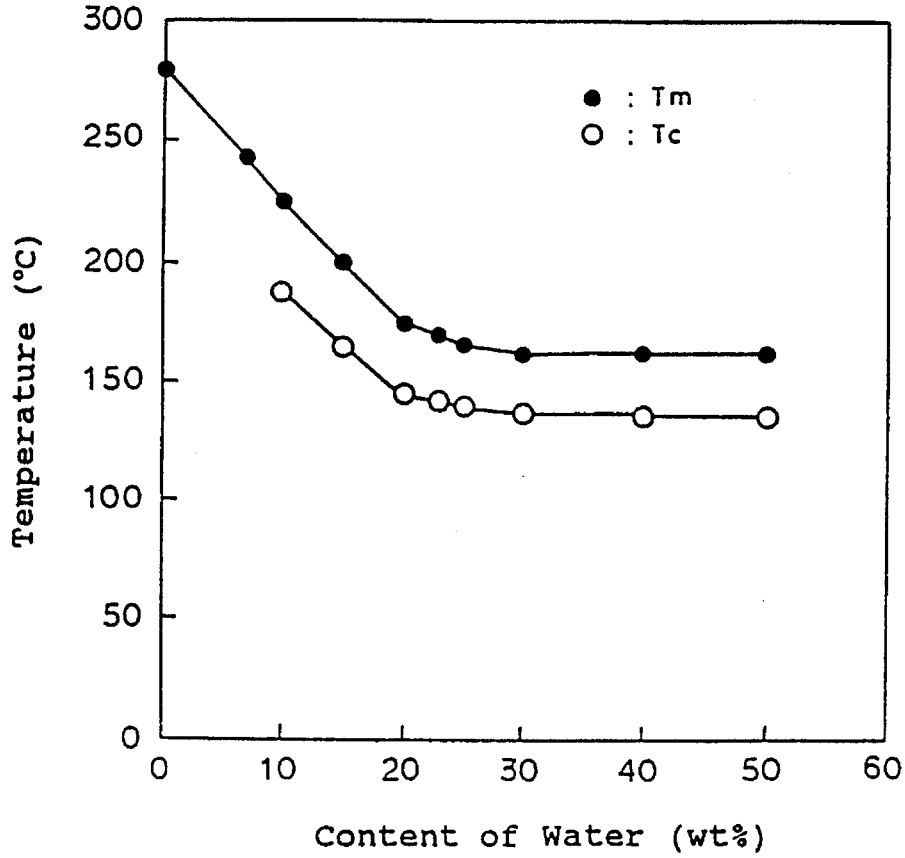
FIG. 2B is a graph which indicates changes in the melting and the solidifying temperatures of a PAN/$H_2O$ mixture (PAN consisting of 92.8% acrylonitrile (by weight) and 7.2% methylacrylate (by weight)) as a function of the water content.

FIG. 1B and FIG. 2B are the embodiments of FIG. 1A and FIG. 2A, respectively. FIG. 1B represents a case in which 25% water (by weight) is mixed with PAN containing 92.8% by weight of acrylonitrile and 7.2% by weight of methacrylate. FIG. 2B represents a case in which the water content is varied from 5% to 50% by weight.

FIG. 4 is a graph illustrating changes in the degree of orientation depending on the extrusion temperature. A series of PAN/$H_2O$ melts were extruded by using the same extruder under the same extrusion conditions, while changing the extruding temperature. The extrudates were subject to X-ray diffraction to determine the degree of orientation. The data in FIG. 4 show that the PAN molecular chains of the extrudates formed at a gel crystal-forming temperature can be easily oriented to a high degree even by the weak shear force generated during extrusion, while the molecular chains of the extrudate formed at an elevated temperature at which the amorphous melt is formed is hardly oriented.

According to the invention, an acrylic staple fiber can be produced through a simple process by mixing PAN with an amount of water, and then melting and extruding the resulting PAN hydrate at a relatively low temperature under reduced pressure. Thus, the production cost is greatly reduced compared with the conventional processes. The present invention does not cause any environmental pollution problems because it does not use any hazardous solvents. Furthermore, acrylic fibers with excellent properties can be obtained in a white color. The white color is formed due to the temperature range wherein PAN/$H_2O$ melt is maintained as a supercooled state. The fibers of the present invention have an appearance similar to those of flax, in which a plurality of fibrils constitute the fibers.

The fibers according to the invention show superior physical properties to the conventional fibers, attributing to the high degree of orientation in the molecular chains. Since the fibers of the invention consist of a large number of unit fibrils or microfibrils, the surface area thereof is very large. The irregular cross-sectional configuration and the various sizes of the fibers according to the invention increase the binding force with other materials significantly.

The present invention has the advantage that highly-oriented fibers can be obtained by using PAN containing a large amount of acrylonitrile. The fibers of the present invention have an initial tensile modulus of 500 kg/mm$^2$ and is thus useful as staple fibers for spinning. The fibers of the present invention can be processed into acrylic fibrous materials useful as an industrial material, such as a composite, a heat insulating and heat resistant fiber, a cement reinforcing fiber, a paper making fiber, and the like. The fibers according to the present invention can also be used as substitutes for natural fibers such as ramie, flax, linen, hemp, jute, and the like.

DESCRIPTION OF THE PREFERRED EMBODIMENTS

The invention will be described in greater detail by way of the following examples. The examples are presented for illustrative purposes and should not be construed as limiting the invention which is properly delineated in the claims. In the following examples, the "elongation" means mechanical action applied to axis orientation of the fiber in order to enhance the degree of molecular orientation of the produced fiber. The "specific surface area (m$^2$/g)" is calculated from the value of surface area (m$^2$) of the desired amount of fiber divided by surface area of 1 g of fiber.

EXAMPLE 1

A mixture of 30 parts water (by weight) and 100 parts an acrylonitrile copolymer (by weight) consisting of 92.8% acrylonitrile (by weight) and 7.2% methylacrylate (by weight) and having a viscosity average molecular weight of 172,000, was placed into a sealed extruder equipped with a cylinder, a piston and a slit die. Thereafter, the mixture was heated to 175° C. and maintained at the same temperature for 10 minutes to form a complete melt. The temperature of the extruder was lowered, and maintained at 140° C. The melt was extruded through a slit die having a thickness/width/length of 0.30 mm/15 mm/1 mm into the atmosphere at ambient temperature and pressure at an extrusion rate of 5 m/min. to produce continuous tape-shaped extrudates. These extrudates were then wound around a drum at the rate of 10 m/min.

The structure of the resulting extrudate were observed by using a scanning electron microscope. The observation showed that the extrudates had a sectional structure in which fibrils having 0.1 to 1 μm in thickness were uniformly laminated at proper intervals.

According to an X-ray diffraction analysis, the tape-shaped extrudates had fibrous crystal structures showing a 90% orientation. The tape-shaped extrudates were subject to longitudinal opening producing long fibers having a thickness of 5 to 200 μm and a length of 20 to 100 mm. Mechanical properties of the resulting fibers were: tensile strength of 53 kg/mm$^2$, elongation of 10%, and initial tensile modulus of 650 kg/mm$^2$.

EXAMPLE 2

The continuous tape-shaped extrudate prepared according to the method of Example 1 was heat-elongated 10% under a steam atmosphere at 120° C. to obtain an elongated extrudate, which showed 93% orientation by X-ray diffraction. The resulting extrudate was subject to longitudinal opening to form long fibers 5 to 200 μm in thickness and 20 to 100 mm in length. Mechanical properties of the fibers were; tensile strength of 61 kg/mm$^2$, elongation of 8%, and initial tensile modulus of 910 kg/mm$^2$.

EXAMPLE 3

A mixture of 25 g of water and 100 g of an acrylonitrile copolymer consisting of 88.6% acrylonitrile and 11.4% methylacrylate and having a viscosity average molecular weight of 215,000, was placed into a continuous operating sealable extruder equipped with a wrap, a cylinder, and a slit die. The extruder had five temperature regions wherein a feed input was maintained at room temperature, middle portions were at 150° C., 180° C. and 150° C., respectively, and the die was at 140° C. The mixture was extruded through a slit die having a thickness/width/length of 0.40 mm/20 mm/2.0 mm into the atmosphere at an extrusion rate of 10 m/min. to produce continuous tape-shaped extrudates. These extrudates were then wound at the rate of 18 m/min.

According to an X-ray diffraction analysis, the tape-shaped extrudates had fibrous crystal structures showing a 85% orientation. Continuous tape-shaped extrudates were subject to longitudinal opening to form long fibers. Mechanical properties of the resulting fibers were: tensile strength of 35 kg/mm$^2$, elongation of 10%, and initial tensile modulus of 530 kg/mm$^2$.

EXAMPLE 4

A mixture of 40 g of water and 100 g of an acrylonitrile homopolymer having a viscosity average molecular weight of 135,000, was placed into a sealable extruder equipped with a cylinder, a piston and a slit die. Thereafter, the mixture was heated to a temperature of 205° C. under a pressure of 5 kg/cm$^2$ to form a complete melt. The melt was cooled to 170° C. and maintained at the same temperature, and was then extruded through a slit die having a thickness/width/length of 0.50 mm/20 mm/4 mm into the atmosphere at ambient temperature and pressure at an extrusion rate of 3 m/min. to produce continuous tape-shaped extrudates. These extrudates were then wound at the rate of 6 m/min.

According to an X-ray diffraction analysis, the tape-shaped extrudates had fibrous crystal structures showing a 91% orientation. Continuous tape-shaped extrudates were subject to longitudinal opening to form long fibers. Mechanical properties of the resulting fibers were: tensile strength of 4.4 kg/mm$^2$, elongation of 8%, and initial tensile modulus of 780 kg/mm$^2$.

EXAMPLE 5

A mixture of 26 g of water and 100 g of an acrylonitrile copolymer consisting of 94.2% acrylonitrile and 5.2% vinyl acetate and having a viscosity average molecular weight of 197,000, was placed into a sealable extruder equipped with a cylinder, a piston and a slit die. Thereafter, the mixture was heated to 180° C. under a pressure of 5 kg/cm$^2$ to form a complete melt. The melt was cooled to 150° C. and maintained at the same temperature. The melt was extruded through a slit die having a thickness/width/length of 0.30 mm/15 mm/1 mm at an extrusion rate of 2 m/min. to produce continuous tape-shaped extrudates. These extrudates were then wound at the rate of 5 m/min.

According to an X-ray diffraction analysis, the tape-shaped extrudates had fibrous crystal structures showing a 90% orientation. Continuous tape-shaped extrudates were subject to longitudinal opening to form long fibers. Mechanical properties of the resulting long fibers were: tensile strength of 45 kg/mm$^2$, elongation of 10%, and initial tensile modulus of 710 kg/mm$^2$.

EXAMPLE 6

A mixture of 45 g of water and 100 g of an acrylonitrile homopolymer having a viscosity average molecular weight of 203,000, was placed into a sealable extruder equipped with a cylinder, a piston and a slit die. Thereafter, the mixture was heated to 200° C. under a pressure of 5 kg/cm$^2$ to form a complete melt. The melt was cooled to 173° C. and maintained at the same temperature, and was then extruded through a slit die having a thickness/width/length of 0.30 mm/15 mm/1 mm at an extrusion rate of 5 m/min. to produce continuous tape-shaped extrudates. These extrudates were then wound at the rate of 1.5 m/min.

According to an X-ray diffraction analysis, the tape-shaped extrudates had fibrous crystal structures showing a 92% orientation. Continuous tape-shaped extrudates were subject to longitudinal opening to form long fibers. Mechanical properties of the resulting fibers were: tensile strength of 47 kg/mm$^2$, elongation of 8%, and initial tensile modulus of 850 kg/mm$^2$.

EXAMPLE 7

A mixture of 20 g of water and 100 g of an acrylonitrile copolymer consisting of 83.8% acrylonitrile and 16.2% vinyl acetate and having a viscosity average molecular weight of 176,000 was placed into a sealable extruder equipped with a cylinder, a piston and a slit die. Thereafter, the mixture was heated to 165° C. under a pressure of 5 kg/cm$^2$ to form a complete melt. The melt was cooled to 130° C. and maintained at the same temperature, and was then extruded through a slit die having a thickness/width/length of 0.40 mm/20 mm/2.0 mm at an extrusion rate of 5 m/min. to produce continuous tape-shaped extrudates. These extrudates were then wound up at the rate of 15 m/min.

According to an X-ray diffraction analysis, the tape-shaped extrudates had fibrous crystal structures showing a 85% orientation. Continuous tape-shaped extrudates were subject to longitudinal opening to form long fibers. Mechanical properties of the resulting fibers were: tensile strength of 28 kg/mm$^2$, elongation of 15%, and initial tensile modulus of 340 kg/mm$^2$.

EXAMPLE 8

A mixture of 35 g of water and 100 g of an acrylonitrile copolymer consisting of 91.5% acrylonitrile and 8.5% methyl methacrylate and having a viscosity average molecular weight of 162,000, was placed into a sealable extruder equipped with a cylinder, a piston and a slit die. Thereafter, the mixture was heated to 175° C. under a pressure of 5 kg/cm$^2$ to form a complete melt. The melt was cooled to 143° C. and maintained at the same temperature, and was then extruded through a slit die having a thickness/width/length of 0.3 mm/15 mm/1.0 mm to produce continuous tape-shaped extrudates. These extrudates were then wound at the rate of 15 m/min.

According to an X-ray diffraction analysis, the tape-shaped extrudates had fibrous crystal structures showing a 90% orientation. Continuous tape-shaped extrudates were divided into and were subject to longitudinal opening to form long fibers. Mechanical properties of the resulting fibers were: tensile strength of 34 kg/mm$^2$, elongation of 10%, and initial tensile modulus of 520 kg/mm$^2$.

EXAMPLE 9

A mixture of 22 g of water and 100 g of an acrylonitrile copolymer consisting of 87.1% acrylonitrile and 12.9% methyl methacrylate and having a viscosity average molecular weight of 112,000, was placed into a sealable extruder equipped with a cylinder, a piston and a slit die. Thereafter, the mixture was heated to 170° C. under a pressure of 5 $kg/cm^2$ to form a complete melt. The melt was cooled to 140° C. and maintained at the same temperature, and was then extruded through a slit die having a thickness/width/length of 0.2 mm/15 mm/0.5 mm at an extrusion rate of 3 m/min. to produce continuous tape-shaped extrudates. The extrudates were then wound at the rate of 7 m/min.

According to an X-ray diffraction analysis, the tape-shaped extrudates had fibrous crystal structures showing a 87% orientation. Continuous tape-shaped extrudates were subject to longitudinal opening to form long fibers. Mechanical properties of the resulting fibers were: tensile strength of 36 $kg/mm^2$, elongation of 12%, and initial tensile modulus of 510 $kg/mm^2$.

COMPARATIVE EXAMPLE

For the purpose of comparison, a mixture of water and acrylonitrile copolymer which had the same composition with that of Example 1, was placed into the same extruder with that of Example 1, and was heated to 175° C. under a pressure of 5 $kg/cm^2$ to form a complete melt. The melt was extruded through a slit die having a thickness/width/length of 0.3 mm/15 mm/1 mm into the atmosphere at ambient temperature and pressure to produce continuous, foamy extrudates.

An X-ray diffraction analysis revealed that the extrudates had orientation of 50% and failed to form any fiber.

What is claimed is:

1. A white acrylic staple fiber which is prepared by a simple extrusion of a gel crystal formed from a PAN/$H_2O$ mixture without spinning, consisting of fibrils which are extended and uniformly gathered in parallel with each other, and said fiber having the following properties: a degree of orientation observed by X-ray diffraction of 80–97%; a length of 5–500 mm; a thickness of 5–500 μm; a length to thickness ratio of 100–100,000 determined by a scanning electromicroscope; a tensile strength of 10–70 $kg/mm^2$; an initial tensile modulus of 300–1,500 $kg/mm^2$; an elongation of 5–20%; and a specific surface area of 1–50 $m^2/g$.

2. The acrylic fiber according to claim 1, wherein the PAN/$H_2O$ mixture consists of 10 to 100 parts water (by weight) with respect to the total weight of PAN.

3. The acrylic fiber according to claim 1, wherein the fibrils have a thickness distribution of 0.1 to 5 μm.

* * * * *